United States Patent [19]

Kelsey

[11] 4,162,790

[45] Jul. 31, 1979

[54] CONNECTOR ASSEMBLY FOR A BALL AND CORD

[75] Inventor: David R. Kelsey, Barnet, England

[73] Assignee: D. R. K. Limited, Barnet, England

[21] Appl. No.: 879,376

[22] Filed: Feb. 21, 1978

[30] Foreign Application Priority Data

Mar. 18, 1977 [GB] United Kingdom ..... 11570/77

[51] Int. Cl.[2] ..... A63B 67/10; A63B 43/00

[52] U.S. Cl. ..... 273/58 C; 273/95 A; 273/DIG. 26

[58] Field of Search ..... 273/58 C, 95 A, 26 E, 273/29 A

[56] References Cited

U.S. PATENT DOCUMENTS

| | | | |
|---|---|---|---|
| 2,186,016 | 1/1940 | Evans | 273/58 C |
| 3,216,723 | 11/1965 | Galezniak | 273/58 C |
| 3,637,209 | 1/1972 | Raut | 273/58 C |
| 3,729,195 | 4/1973 | Hutt et al. | 273/58 C |
| 3,764,140 | 10/1973 | Lotfy | 273/58 C |
| 3,829,093 | 8/1974 | Abrams | 273/58 C |
| 3,934,873 | 1/1976 | Griffin | 273/58 C |
| 3,994,494 | 11/1976 | Kelley | 273/26 E |
| 4,088,319 | 5/1978 | Clarke | 273/58 C |
| 4,113,257 | 9/1978 | Moffatt | 273/58 C |

*Primary Examiner*—Richard C. Pinkham
*Assistant Examiner*—Lawrence E. Anderson
*Attorney, Agent, or Firm*—Prutzman, Kalb, Chilton & Alix

[57] ABSTRACT

Apparatus for attaching the end of a length of string or cord to a hollow ball which includes a tubular member having two flanges intended to be positioned one inside the ball and the other outside or towards the outside of the ball, a washer intended to be trapped between the internal wall of the ball and the internal flange of the tubular member, the internal flange and the washer aperture having co-operating part-conical surfaces, and a collar having a conical surface adapted to engage a complementary conical surface on the side of the internal flange of the tubular member remote from the washer, the arrangement being such that, in use, tension or shock loading applied to the string or cord will cause the washer to flex.

10 Claims, 7 Drawing Figures

CONNECTOR ASSEMBLY FOR A BALL AND CORD

BACKGROUND

This invention relates to apparatus for playing a game of the type in which a ball is tethered by means of a length of string or cord, and one or more players endeavour to hit the ball with a bat or racquet.

It is an object of the present invention to provide improved apparatus for this purpose.

SUMMARY

The present invention consists in means for attaching the end of a length of string or cord to a hollow ball which includes a tubular member having two flanges intended to be positioned one inside the ball and the other outside or towards the outside of the ball, a washer intended to be trapped between the internal wall of the ball and the internal flange of the tubular member, the internal flange and the washer aperture having cooperating part-conical surfaces, and a collar having a conical surface adapted to engage a complementary conical surface on the side of the internal flange of the tubular member remote from the washer, the arrangement being such that, in use, tension or shock loading applied to the string or cord will cause the washer to flex.

The invention further consists in apparatus for playing a game, which includes attachment means as set forth in the preceding paragraph and a ball attached to the end of a length of string or cord by means of said attachment means.

The invention still further consists in apparatus as set forth in the preceding paragraph, wherein the other end of the string or cord is attached to a rod or like member which is attached to the top of a post by means of a nut fixed to the post and a threaded bolt fitted in the nut, both sides of the nut and both ends of the bolt having sloping ramps with square end faces adapted to prevent jamming together of the nut and bolt at each end of the relative travel between nut and bolt.

The invention still further consists in apparatus as set forth in the preceding paragraph, wherein the post is tubular metal and is adapted to permit one end of it to be stuck or hammered into the ground by deforming a length of the tube inwardly with a set of three or more wheels arranged around the tube and then further deforming inwardly the deformed tube by means of one or more further sets of wheels arranged more closely together.

In the accompanying drawings:

FIG. 1 shows a detail of one form of apparatus according to the present invention, FIG. 2 shows a further detail of apparatus according to the present invention, FIG. 3 shows a still further detail of apparatus according to the present invention, and FIGS. 4 to 7 are cross sections taken on lines 4—4 to 7—7 respectively of FIG. 3.

DETAILED DESCRIPTION

Figure 1:
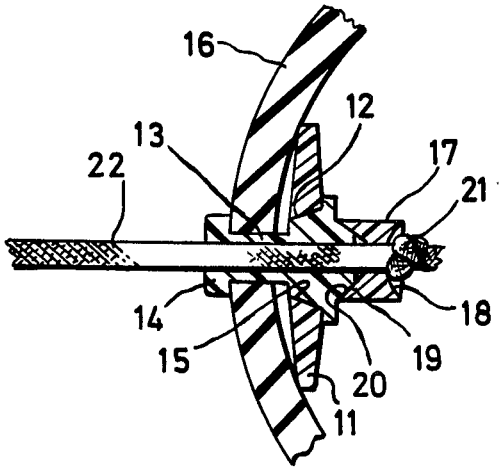

In carrying the invention into effect according to one convenient mode by way of example, the accompanying drawings show details of apparatus for playing a game in which the players, preferably one or two, attempt to hit a ball secured to a string which is in turn attached to a thin steel arm pivoted to a plastic screw revolving in a plastic nut, the latter being fixed into the top of a steel tube. The tube is pushed into the ground, or alternatively is supported by a sand or water filled hollow plastic base.

Means are provided for preventing the string from winding up if the ball is hit with spin applied, and at the same time, a certain amount of resilience is provided in the attachment to reduce shock to the ball and other fittings.

The ball fitting is made in three parts which mate together. One part is a large, generally flat washer 11, of a smoothly tapering section on each side of its central hole, the hole being of conical section as at 12.

The second part comprises a tubular member 13 with a rounded flange 14 at one end, and a conical section 15 at the other which fits into the conical hole 12 in the washer, while the rounded flange 14 protrudes through a hole in the ball 16, from the inside.

The third part is a short tubular collar 17, having a spherical cavity 18 at one end, and a conical cavity 19 at the other. The conical cavity 19 mates with a corresponding male conical section 20 on the end of the second part 13, while the spherical cavity 18 accepts a knot 21 tied in the attachment cord 22.

The parts 13, 11 and 17 are assembled on to the cord 22 in the appropriate sequence, and the whole lot is then inserted into a small hole in the ball 16, expanding forceps being used to open and expand the hole sufficiently for the components to pass through easily. By means of the cord, the assembly is then pulled back up into the hole so that the rounded flange 14 on the second part 13 pops through the hole and retains the assembly in place.

The surface of the tapered washer 11 facing the inside wall of the ball is flat (thereby forming a chord to the inside curvature of the ball) or has a radius of curvature greater than that of the inside wall of the ball or is oppositely curved so that the washer 11 engages the inside wall of the ball only at the periphery of the washer and so that when tension or shock loading is applied to the cord, the tapered washer 11 flexes, tending to conform to the curvature of the inside wall of the ball, and the rounded flange 14 momentarily protrudes further from the ball, smoothing out the shock and reducing the chance of breakage to any part.

Being considerably larger in area than the hole in the ball, and being retained in a chordal position by the large tubular part 13, the tapered washer 11 resists being pulled out of the ball in play.

The small tubular piece 13 serves to minimise friction between the knotted cord and the other parts, and the mating of the two conical sections 19 and 20 maintains the cord 22 in a central position in the bore in the large tubular piece 13, thus reducing friction in the bore.

The other end of cord 22 is attached to one end of a steel rod 31 (FIG. 2) formed intermediate its ends with a spring 32 and pivotably attached at its other end to a bolt 33 engaging a split nut 34 fitted into the end of a tubular post 35. The bolt 33 and nut 34 both incorporate pairs of sloping ramps 36 and 37 with square faces which stop the rotation of the bolt 33 at each end of its travel, so as to prevent the locking together of the components at these points.

The halves of the nut 34 have mating pins and sockets (not shown) of tapering section to provide for accurate location when assembled on the bolt, and thereby minimise any friction which develops between the parts.

One half of the nut 34 has a blind hole in its outer surface. When the two halves of the nut are assembled to the bolt, the complete assembly is pushed into the end of the post 35, and the wall of the tube is dented in at the position of the blind hole as at 38, so as to lock the assembly in place both axially and radially.

The top of the bolt 33 has a slotted boss to which the rod 31 is pivoted by means of a tubular pin 39 in such a way that the rod can move up and down freely whilst being firmly located in the other plane. The wire is of springy steel, and the spring 32 provides additional springyness in order to reduce the shock when the screw is rotated rapidly to its stops at each end of its travel.

Each player has a bat similar to a large table tennis bat, made of wood or plastic or other materials. The screw is set in its central position, and each player hits the ball in a circle around the pole until one or the other forces the screw up to its stop, thereby gaining a point. Other variations of the game are possible according to the imagination of the players.

Figure 2:
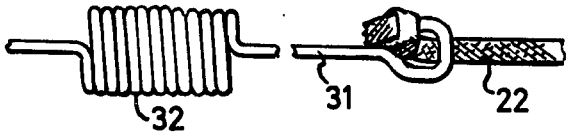
Figure 3:
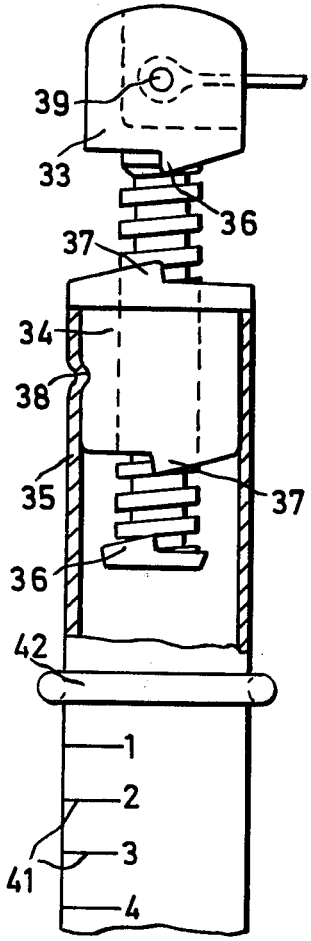
Figure 3:
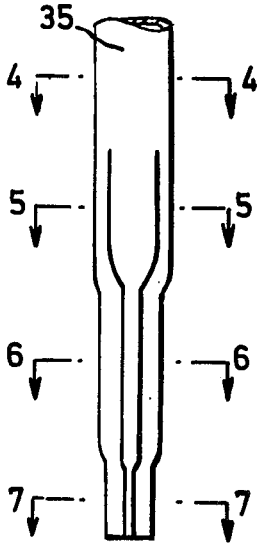
Figure 4:
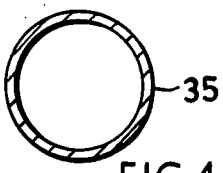
Figure 5:
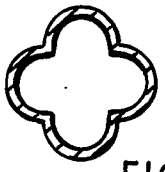
Figure 6:
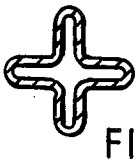
Figure 7:
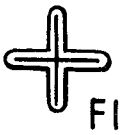

The post 35 incorporates a scoring device as shown in the lower part of FIG. 2. Markings 41 are applied to the post 35 so as to constitute a scale and an O-ring 42 is fitted on the post 35. The spacing of the markings 41 in relation to the diameter of the cross-section is such that when the O-ring is rolled along the post from one undistorted position to the next it will travel from one marking 41 to the next. This provides a convenient way of marking the score, two O-rings and scales being provided along the length of the post, one for each player.

The lower end of the post 35 is deformed as shown in FIGS. 3 to 7 into four leaves of cross-shaped section, gradually towards the end of the tube.

The deformation is achieved by using several sets of four hardened steel wheels, each wheel having a 90° included angle at its periphery. The wheels are arranged with their axes in one plane at right angles to each other, and set at varying distances apart, but symmetrically.

The sets of four wheels are arranged one above the other, widest apart at one end, and closest at the other, with one or more intermediate steps, the overall separation being approximately the length of tube to be tapered.

The assembly is fitted in a press having a spigot attached to its ram of a diameter which fits the bore of the tube.

The tube is located on the spigot directly above the first set of wheels, and then forced through each set of wheels in turn progressively forming a generally tapered section having four leaves.

In this way, the tube is tapered towards its lower end to form a spike to permit the post to be hammered in the ground.

I claim:

1. A connector assembly means connecting a cord to a hollow ball having an aperture in the wall thereof for retainably receiving an end of the cord comprising a tubular member extending through the aperture in the wall of the ball, said member having flanges adjacent the ends thereof and a bore for passage of the cord therethrough into the interior of the ball, one of said flanges being positioned outside the ball and the other of said flanges being positioned inside the ball, and a flexible washer having an aperture and mounted on said tubular member and being positioned entirely within the ball between the interior wall of the ball and the internal flange, said washer being free from direct contact with the cord extending through the bore of said tubular member, said washer being in cooperative surface engagement with said internal flange and, when no external forces are exerted on the ball or cord, being spaced from the interior wall of said ball near the aperture of the ball thereby engaging the interior wall of the ball only remotely of the apertures of both the washer and ball to provide a spaced relationship between the washer and the interior wall of the ball at the aperture such that, in use, tension or shock loading applied to the cord will cause the washer to flex toward and against the interior wall of the ball.

2. The connector assembly of claim 1 wherein the cooperative surface engagement between said washer and said internal flange includes cooperating part-conical surfaces on the washer and the internal flange.

3. The connector assembly of claim 1 wherein the periphery of said washer engages the interior wall of the ball remote from said aperture.

4. The connector assembly of claim 1 including a collar mounted on the tubular member remote from the washer and adapted to restrainably engage the end of the cord for retention thereof within the ball, said collar and tubular member having cooperating surfaces effective from maintaining the cord in a central position in the bore of the tubular member.

5. The connector assembly of claim 4 wherein the cooperating surfaces of said collar and tubular member include part-conical surfaces and said collar includes a central aperture for receiving the end of said cord.

6. A tethered ball assembly comprising a mounting post, a cord connected at one end to the post, a hollow ball having an aperture in the wall thereof and a connector assembly mounted in said aperture for retainably receiving the other end of the cord and securing it to the ball, said connector assembly comprising a tubular member extending through the aperture in the wall of the ball, said member having flanges adjacent the ends thereof and a bore for passage of the cord therethrough into the interior of the ball, one of said flanges being positioned outside the ball and the other of said flanges being positioned inside of the ball, and a flexible washer having an aperture and mounted on said tubular member and being positioned entirely within the ball between the interior wall of the ball and the internal flange, said washer being free from direct contact with the cord extending through the bore of said tubular member, said washer being in cooperative surface engagement with said internal flange and, when no external forces are exerted on the ball or cord, being spaced from the interior wall of said ball near the aperture of the ball thereby engaging the interior wall of the ball only remotely of the apertures of both the washer and ball to provide a spaced relationship between the washer and the interior wall of the ball at the aperture such that, in use, tension or shock loading applied to the cord will cause the washer to flex toward and against the interior wall of the ball, said mounting post including a fixed threaded member secured to the post and a rotatable threaded member rotatably connected to said fixed member, said one end of said cord being attached to said rotatable member, said threaded members having cooperating jam-preventing means at each end of the relative travel therebetween.

7. The tethered ball assembly of claim 6 wherein the periphery of said washer engages the internal wall of the ball remote from said aperture.

8. The tethered ball assembly of claim 6 including a collar mounted on the tubular member remote from the washer and adapted to restrainably engage the end of the cord for retention thereof within the ball, said collar and tubular member having cooperating surfaces effective from maintaining the cord in a central position in the bore of the tubular member.

9. The tethered ball assembly of claim 6, wherein the post is tubular metal and is adapted to permit one end of it to be stuck or hammered into the ground by deforming a length of the tube inwardly with a set of three or more wheels arranged around the tube and then further deforming inwardly the deformed tube by means of a further set of wheels arranged more closely together.

10. The tethered ball assembly of claim 6, wherein the post is provided with a scale and an O-ring is fitted on the post to serve in co-operation with the scale as a scoring marker.

* * * * *